US010351306B2

(12) United States Patent
Septien Rojas et al.

(10) Patent No.: US 10,351,306 B2
(45) Date of Patent: Jul. 16, 2019

(54) ZIPPER CHILD DETERRENT CLOSURE WITH THREE WEB/FLANGE DESIGN

(71) Applicants: Jose Manuel Septien Rojas, Scarborough (GB); Lars Wihlborg, Stratford, CT (US)

(72) Inventors: Jose Manuel Septien Rojas, Scarborough (GB); Lars Wihlborg, Stratford, CT (US)

(73) Assignee: ILLINOIS TOOL WORKS INC., Glenview, IL (US)

( * ) Notice: Subject to any disclaimer, the term of this patent is extended or adjusted under 35 U.S.C. 154(b) by 0 days.

(21) Appl. No.: 15/770,931

(22) PCT Filed: Nov. 15, 2016

(86) PCT No.: PCT/US2016/061979
§ 371 (c)(1),
(2) Date: Apr. 25, 2018

(87) PCT Pub. No.: WO2017/087359
PCT Pub. Date: May 26, 2017

(65) Prior Publication Data

US 2018/0312302 A1 Nov. 1, 2018

Related U.S. Application Data

(60) Provisional application No. 62/256,207, filed on Nov. 17, 2015.

(51) Int. Cl.
*B65D 33/25* (2006.01)

(52) U.S. Cl.
CPC ..... *B65D 33/2566* (2013.01); *B65D 33/2508* (2013.01); *B65D 33/2541* (2013.01); *B65D 2215/00* (2013.01)

(58) Field of Classification Search
CPC ..... B65D 33/2566; B65D 33/2508; B65D 33/2541; B65D 2215/00
USPC ..... 383/61.2, 63–65
See application file for complete search history.

(56) References Cited

U.S. PATENT DOCUMENTS 3,948,705 A * 4/1976 Ausnit ..... B29C 65/08 156/73.4
5,774,954 A * 7/1998 Ramsey ..... B65D 33/2533 24/304
5,964,399 A * 10/1999 Ruben ..... B65D 5/54 206/813
2018/0362220 A1* 12/2018 Wang ..... B65D 33/2508

FOREIGN PATENT DOCUMENTS

FR 2 998 276 5/2014

* cited by examiner

*Primary Examiner* — Jes F Pascua
(74) *Attorney, Agent, or Firm* — McCarter & English, LLP

(57) ABSTRACT

This disclosure pertains to a child deterrent closure with multiple interlocking elements on each zipper profile. The lower interlocking element of one of the profiles includes an interior flange which is unsealed thereby causing opening forces on that profile to be directed to a lower seal rather than to the lower interlocked elements. The interior flange must be moved to expose the lower interlocked elements and to direct opening forces to the lower interlocked elements.

12 Claims, 2 Drawing Sheets

ZIPPER CHILD DETERRENT CLOSURE WITH THREE WEB/FLANGE DESIGN

This application is a national phase of application no. PCT/US2016/061979 filed on Nov. 15, 2016 which claims priority under 35 U.S.C. 119(e) of U.S. provisional application Ser. No. 62/256,207, filed on Nov. 17, 2015, the contents of which is hereby incorporated by reference in its entirety and for all purposes.

BACKGROUND OF THE DISCLOSURE

Field of the Disclosure

This disclosure pertains to a child deterrent closure with multiple interlocking elements on each zipper profile. The lower interlocking element of one of the profiles includes an interior flange which is unsealed thereby causing opening forces on that profile to be directed to a lower seal rather than to the lower interlocked elements.

Description of the Prior Art

The use of child-deterrent closures is well-established. Many products, particularly pharmaceutical products, need to be kept out of children's access, but should be readily available to adults. In the case of older adults, it can be problematic to provide a closure which is simple and intuitive to use, but which maintains its reliability with respect to child deterrence. Further concerns are the ability of the child-deterrent closure to be adapted to flexible packages, as well as ease and reduced costs in the manufacturing process.

A child-deterrent closure is disclosed in U.S. Published Patent Application 2014/0161374 entitled "Child-Resistant Reclosable Bags."

OBJECTS AND SUMMARY OF THE DISCLOSURE

It is therefore an object of the present disclosure to provide improvements with respect to a child-deterrent closure, particularly with respect to flexible packages.

This and other objects are attained by providing a closure, reclosure or zipper with a first profile side and a second profile side. The first profile side includes first and second female elements, typically attached to a single base which creates a flange structure which is sealed or otherwise secured to a first package or bag wall. The second profile side includes first and second male elements which, in the closed position, are engaged with the respective first and second female elements. The first (or upper) male element has upper and lower flanges which are sealed or otherwise secured to a second package or bag wall, while the second (or lower) male element includes a lower flange secured to the second package or bag wall, while the upper flange is unsealed and blocks access to the engaged second male and female elements. The upper flange of the second male element has to be moved to allow access to the engaged second male and female elements and then grasped so that opening forces are transmitted to the engaged second male and female elements rather than to the seal between the lower flange of the second male element and the second package or bag wall.

BRIEF DESCRIPTION OF THE DRAWINGS

Further objects and advantages of the disclosure will become apparent from the following description and from the accompanying drawings, wherein.

DETAILED DESCRIPTION OF THE PREFERRED EMBODIMENTS

Figure 1:
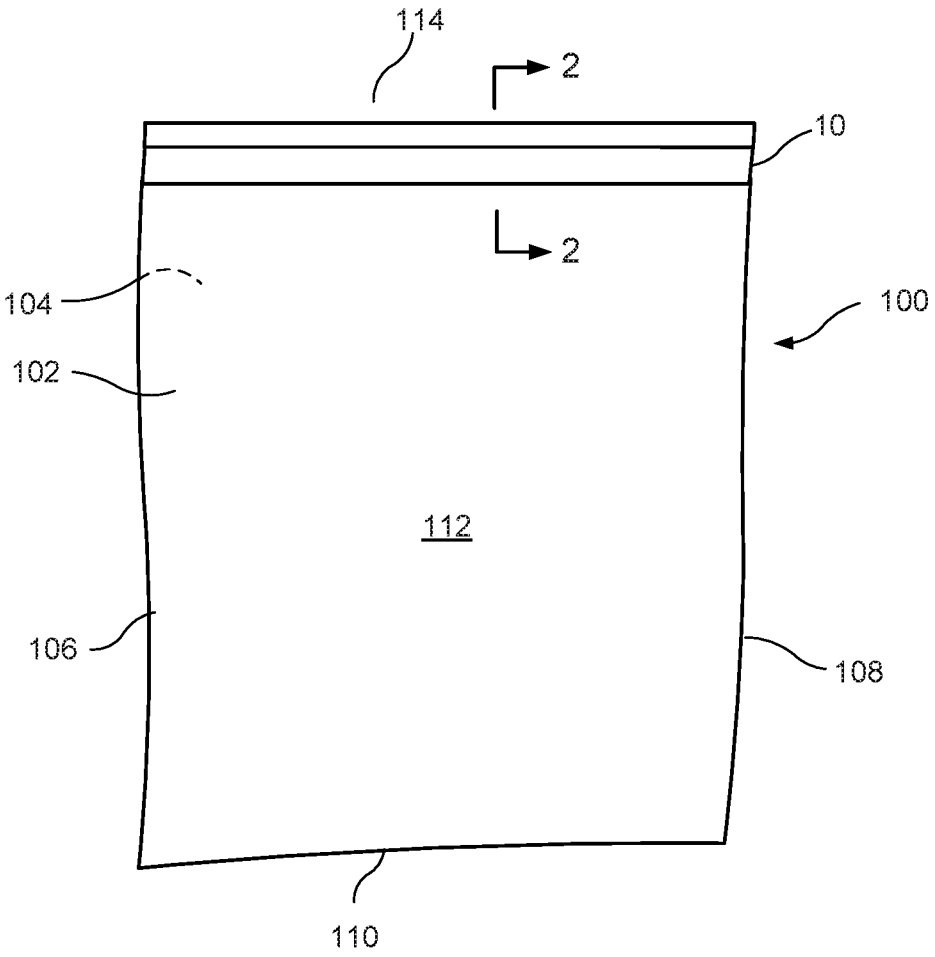
FIG. 1 is a perspective view of a typical package or bag, including an embodiment of the closure, reclosure or zipper of the present disclosure.

Referring now to the drawings in detail, wherein like numerals refer to like elements throughout the several views, one sees that FIG. 1 is a perspective view of a package or bag 100 which may include an embodiment of the closure, reclosure or zipper 10 of the present disclosure. The illustrated package or bag 100 includes co-extensive first and second sheets 102, 104 of polymeric web or film, forming respective first and second bag walls, which are sealed together by first side seal 106, second side seal 108 and bottom seal 110, thereby forming a storage volume 112 between the first and second sheets 102, 104, the storage volume 112 being accessible via mouth 114. In some embodiments, first and second sheets 102, 104 could be formed from a single sheet and bottom seal 110 replaced by a fold. The mouth 114 is made reclosable by closure, reclosure or zipper 10, which is typically likewise made from a polymeric material, which may be different from the polymeric material of the first and second sheets 102, 104. The resulting configuration is adaptable to many applications, including, but not limited to, packaging pharmaceutical products when a flexible, child-resistant package is desired.

Figures 2, 3, 4, 5:
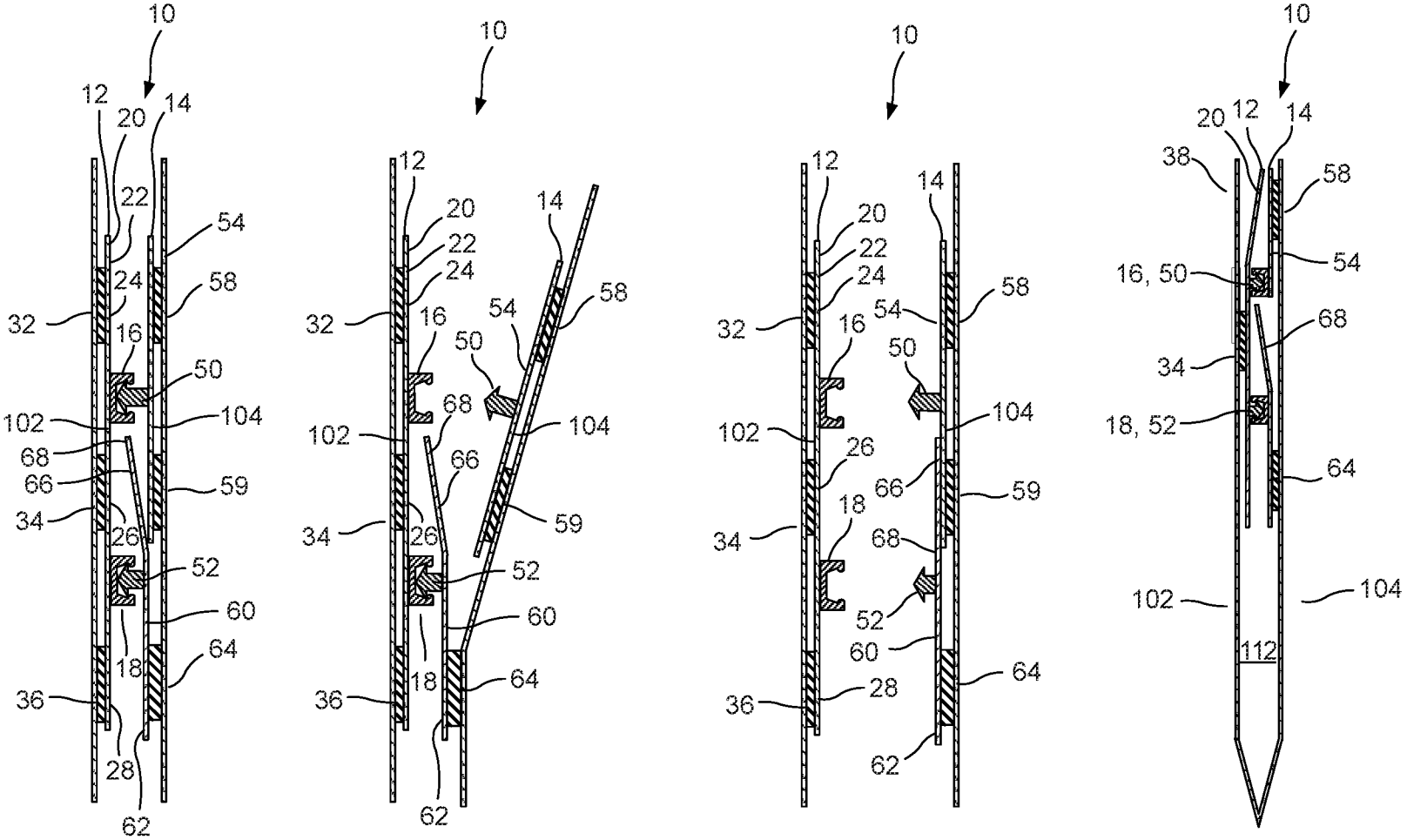
FIG. 2 is a cross-sectional view of an embodiment of the closure, reclosure or zipper of the present disclosure, in a closed configuration, along plane 2-2 of FIG. 1.
FIG. 3 is a cross-sectional view of an embodiment of the closure, reclosure or zipper of the present disclosure, in a partially open configuration, along plane 2-2 of FIG. 1.
FIG. 4 is a cross-sectional view of an embodiment of the closure, reclosure or zipper of the present disclosure, in a fully open configuration, along plane 2-2 of FIG. 1.
FIG. 5 is a cross-sectional view of an alternative embodiment of the closure, reclosure or zipper of the present disclosure, along plane 2-2 of FIG. 1.

As shown in FIGS. 2-4, the closure, reclosure or zipper 10 includes a first profile 12 and a second profile 14, sealed or otherwise attached to the interior of first and second bag walls 102, 104, respectively. The first profile 12 includes a first (or upper) female interlocking element 16 and a second (or lower) female interlocking element 18 on a web element 20 forming a common base 22 for first and second female interlocking elements 16, 18. Common base 22 forms a first upper flange 24, a central base portion 26 and a first lower flange 28 in a co-planar or common plane arrangement. First upper flange 24, central base portion 26 and first lower flange 28 are sealed or otherwise secured to first bag wall 102 by first, second and third seals 32, 34, 36, respectively. In some applications, a different seal arrangement may be used.

The second profile 14 includes a first (or upper) male interlocking element 50 and a second (or lower) male interlocking element 52. As best seen from FIG. 3, the first (or upper) male interlocking element 50 is formed on an upper base 54 which is sealed or otherwise secured on both ends to second bag wall 104 by fourth and fifth seals 58, 59. The second (or lower) male interlocking element 52 is formed on a lower base 60. The lower end 62 of lower base 60 is sealed to second bag wall 104 by sixth seal 64. The upper end 66 of lower base 60 forms an interior flange 68 which is unsealed or unsecured and, in the configuration of FIG. 3, is oriented toward the first profile 12 and blocks access to the interlocked second (or lower) female and male interlocking elements 18, 52. Furthermore, in the configuration of FIG. 3, any opening forces applied from the upper portion of second profile 14 are directed to the sixth seal 64, below and away from the interlocked second (or lower) female and male interlocking elements 18, 52, thereby increasing the required opening forces and making the closure, reclosure or zipper 10, and hence package or bag 100, child-resistant. In order to separate interlocked second (or lower) female and male interlocking elements 18, 52 in FIG. 3 and achieve the open or separated configuration of FIG. 4, the user must move the interior flange 68 away from the first profile 12, thereby exposing the interlocked second (or lower) female and male interlocking elements 18, 52, and applying opening forces on the interior flange 68, thereby directing opening forces to the interlocked second (or lower) female and male interlocking elements 18, 52. This can be done by pushing in on the interior flange 68 from the outside of the bag 100 (i.e., the exterior of first profile 102), thereby allowing access to interlocked second (or lower) female and male interlocking elements 18, 52 and allowing the user to separate the first and second profiles 102, 104, thereby achieving the open configuration of FIG. 3.

In summary, FIG. 2 illustrates the full closed and interlocked configuration of closure, reclosure or zipper 10. FIG. 3 illustrates the first opening step wherein the upper end of common base 22 (or first bag wall 102) is separated from the upper end of upper base 54 (or second bag wall 104) thereby disengaging the first (or upper) female and male interlocking elements 16, 50 while leaving interior flange 68 against the first profile 102. This configuration directs any further opening forces to sixth seal 64 and away from interlocked second (or lower) female and male interlocking elements 18, 52. In order to direct opening forces toward second (or lower) female and male interlocking elements 18, 52, the user moves the interior flange 68 toward the second profile 104 and provides opening forces to the first profile 102 and the interior flange 68 (typically opening forces applied to the interior flange 68 are likewise applied by gripping both the interior flange 68 and the second profile 104) thereby separating second (or lower) female and male interlocking elements 18, 52 and reaching the open configuration of FIG. 4.

In some embodiments, second and fifth seals 34, 59 may be omitted. Furthermore, in some embodiments, fourth seal 58 could be omitted so that initial opening forces would be applied to fifth seal 59 rather than the first (or upper) female and male interlocking elements 16, 50, similar to the configuration described for sixth seal 64 and second (or lower) female and male interlocking elements 18, 52. Further alternative embodiments could substitute other locking elements such as J-hooks, VELCRO® (i.e., hook and eye), APLIX®, etc. for the disclosed male and female interlocking elements.

In the embodiment of the disclosure illustrated in FIG. 5, the first, third and fifth seals 32, 36 and 59, as well as the lower part of upper base 54, have been eliminated thereby creating a hinged effect when the user attempts to pinch grip (i.e., pulling on the bag walls below the level of the profiles) in order to open the bag. This hinged effect makes the closure (and hence the bag) much more difficult to be opened by a child.

Thus the several aforementioned objects and advantages are most effectively attained. Although preferred embodiments of the invention have been disclosed and described in detail herein, it should be understood that this invention is in no sense limited thereby.

What is claimed is:

1. A closure, reclosure or zipper, comprising:

a first profile including a first upper interlocking element and a first lower interlocking element;

a second profile including a second upper interlocking element and a second lower interlocking element configured and arranged to interlock with the respective first upper and lower interlocking elements;

the first upper interlocking element and the first lower interlocking element being located on a first base element;

the second upper interlocking element being located on a second base element, the second lower interlocking element being located on a third base element, the third base element including an upper flange element and a lower flange element, the upper flange extending to the second base element and being free of sealing to the second base element;

wherein the first base element includes a first upper flange element and a first lower flange element, the second base element includes a second upper flange element and a second lower flange element, and the upper and lower flange elements of the third base are respective third upper and lower flanges; and wherein the third upper flange is an interior flange, and wherein the interior flange is oriented toward the first profile.

2. The closure, reclosure or zipper of claim 1 wherein the first upper and lower interlocking elements are female elements and the second upper and lower interlocking elements are male elements.

3. The closure, reclosure or zipper of claim 1 wherein the first and second profiles are comprised of polymeric material.

4. The closure, reclosure or zipper of claim 1 wherein the first upper and lower flanges are configured and arranged to be sealed or attached to a first bag wall; the second upper flange, the second lower flange and the third lower flange are configured and arranged to be sealed or attached to a second bag wall, the third upper flange is configured and arranged to be free of sealing to a first bag wall and a second bag wall.

5. The closure, reclosure or zipper of claim 4 wherein the third lower flange is configured and arranged to be attached or sealed to a second bag wall at a position below the second lower interlocking element, whereby opening forces on the second profile are directed away from the second lower interlocking element, interlocked with the first lower interlocking element, and directed toward the place of attachment of the third lower flange to a second bag wall.

6. The closure, reclosure or zipper of claim 5, wherein opening forces can be applied to the third upper flange, thereby directing opening forces to the first and second lower interlocking elements.

7. A reclosable bag or container, comprising:

first and second bag walls, forming a storage volume therebetween and a mouth leading to the storage volume, the storage volume being made reclosable by a closure, reclosure or zipper;

the closure, reclosure or zipper including:

a first profile including a first upper interlocking element and a first lower interlocking element;

a second profile including a second upper interlocking element and a second lower interlocking element configured and arranged to interlock with the respective first upper and lower interlocking elements;

the first upper interlocking element and the first lower interlocking element being located on a first base element;

the second upper interlocking element being located on a second base element, the second lower interlocking element being located on a third base element, the third base element including an upper flange element and a lower flange element, the upper flange extending to the second base element and being free of sealing to the second base element;

wherein the first base element includes a first upper flange element and a first lower flange element, the second base element includes a second upper flange element and a second lower flange element, and the upper and lower flange elements of the third base are respective third upper and lower flanges; and wherein the third upper flange is an interior flange, and wherein the interior flange is oriented toward the first profile.

8. The reclosable bag or container of claim 7 wherein the first upper and lower interlocking elements are female elements and the second upper and lower interlocking elements are male elements.

9. The reclosable bag or container of claim 7 wherein the first and second profiles and the first and second bag walls are comprised of polymeric material.

10. The reclosable bag or container of claim 7 wherein the first upper and lower flanges are sealed or attached to the first bag wall; the second upper flange, the second lower flange and the third lower flange sealed or attached to the second bag wall, the third upper flange is free of sealing to a first bag wall and a second bag wall.

11. The reclosable bag or container of claim 10 wherein the third lower flange is attached or sealed to the second bag wall at a position below the second lower interlocking element, whereby opening forces on the second profile are directed away from the second lower interlocking element, interlocked with the first lower interlocking element, and directed toward the place of attachment of the third lower flange to the second bag wall.

12. The reclosable bag or container of claim 11 wherein opening forces can be applied to the third upper flange, thereby directing opening forces to the first and second lower interlocking elements.

* * * * *